United States Patent [19]

Gaudette

[11] 4,123,304

[45] Oct. 31, 1978

[54] JELLY TUBE CONSTRUCTION AND METHOD OF WATERPROOFING CABLE

[76] Inventor: Norman O. Gaudette, 221 Partition St., Warwick, R.I. 02888

[21] Appl. No.: 754,825

[22] Filed: Dec. 27, 1976

[51] Int. Cl.[2] ..... H01B 13/00

[52] U.S. Cl. ..... 156/48; 156/73.6

[58] Field of Search ..... 156/48, 47, 73.6, 145, 156/146; 118/50, 57, 404, 405

[56] References Cited

U.S. PATENT DOCUMENTS

| | | | |
|---|---|---|---|
| 3,145,127 | 8/1964 | Baun | 156/73.6 |
| 3,779,844 | 12/1973 | Dorsch | 156/73.6 |
| 3,789,099 | 1/1974 | Garrett et al. | 156/48 |
| 3,923,570 | 12/1975 | Willem | 156/73.6 |

*Primary Examiner*—Douglas J. Drummond
*Assistant Examiner*—William H. Thrower
*Attorney, Agent, or Firm*—Salter & Michaelson

[57] ABSTRACT

A novel apparatus and operational system for the improved waterproofing impregnation of an already stranded core of communication cable and the like with a jelly-like waterproofing compound by the application of vibratory energy is disclosed. The vibrational forces imparted to the jelly-like waterproofing compound enables such to more completely and/or more quickly penetrate the interstices of such stranded core.

7 Claims, 5 Drawing Figures

JELLY TUBE CONSTRUCTION AND METHOD OF WATERPROOFING CABLE

BACKGROUND OF THE INVENTION

This invention relates to an apparatus and method for producing waterproof cable, particularly that type of cable such as communication cable made up of a great number of individual insulated wires bundled together in a tightly packed core. More specifically the invention deals with a method and apparatus for the application of vibrational energy to such jelly-like waterproofing compound so as to enable such to more rapidly and more completely penetrate the inner interstices of such core.

It is desirable to waterproof many types of cable, particularly communication cable, such as above ground or buried telephone communication cable, wherein a plurality of individual wire conductors are coated by extrusion with an insulating material, and each such insulated conductor is subsequently twisted with another insulated conductor to form a twisted pair. A plurality of such twisted pairs of insulated conductors are then stranded together to form a cable core. It is common that several hundred such conductors may be present in such cable cores.

Inasmuch as it is desirable to minimize, to the extent possible, the entrance of moisture into such cable core, it is common to attempt to fill the voids of the interstitial structure of the core of the cable with a compound which has properties sufficient to minimize or prevent the entry of such moisture. Generally such compounds should be capable of becoming at least semi-liquid at elevated application temperatures and pressures and capable of becoming viscous or solid state at those temperatures in which they are utilized in the finished cable structure and include mixtures of petroleum jelly, microcrystalline petroleum waxes, polyethylene, polyisobutylene, aluminum stearate, mixtures of whiting and castor oil, microcrystalline petroleum waxes, and blends of two or more such above-indicated filling materials. Such materials are generally referred to in the trade as jelly and are applied to the cable core in an elongated tube or chamber commonly referred to as a jelly tube. Accordingly, it is common to supply such jelly material in a semi-liquid or jelly-like state into the confines of such tube under a differential pressure caused either by the direct application of pressure to the material within the tube or by maintaining both the entrance and exit portions of the tube under evacuation. The cable core thus becomes flooded with such jelly material and at least to some extent the interstices thereof are filled so as to provide the desired waterproofing effect.

After the application of such jelly, a thermal barrier tape, referred to as a core wrap, and a metal sheathing are then wrapped about the cable core and a jacketing layer of plastic insulation extruded over the sheathing to complete the structure of the cable. Accordingly the jelly application step is one of a series of steps required to form cable of the type under consideration. Such steps are generally conducted continuously and accordingly involve substantial space and equipment outlays. Naturally these additional protective layers further prevent the penetration of moisture to the interior of the cable core. However, as it is possible that such outer protective layers could be broken as by digging operations or earth shift when buried, or accidental blows to such cable when located above ground, it is particularly desirable that all of the voids, even in the inner locations of such core, be completely filled with such waterproofing jelly material.

However, in some applications, particularly those in which several hundred individual insulated strands are utilized to form cable cores, it is extremely difficult in some cases and especially at high production speeds to assure that the proper penetration into the interior interstices of the core by such jelly material is achieved.

SUMMARY OF THE INVENTION

It is therefore a primary object of this invention to provide both a new and improved apparatus and method for continuously applying such jelly-like material to cores of such cable to completely insure that all the interstices thereof are completely filled with such waterproofing material.

Another object of the invention is to provide both a novel apparatus and method for assuring the complete penetration into the innermost portions of such cable core with waterproofing jelly-like material in as short a time span as is possible so as to enable high production rates in the formation of such cable.

A still further object of the invention is to provide an apparatus and method for forcing a jelly-like waterproofing compound into the voids of the interstitial structure of an axially moving cable core by imparting vibratory energy to such jelly-like material to increase its penetration into said core.

A still further object of the present invention is the provision of a novel apparatus and production method for forcing waterproofing compounds of jelly-like consistency to the interstitial voids of a cable core by the application of vibratory energy thereto in a manner and by means which assure the even distribution of such energy to the jelly during its contact with such core.

The above objects of the invention are accomplished by the provision of a jelly tube through which a core comprising a bundle of individual conductors is continually advanced into and out of such tube, means for introducing jelly into said tube in at least a semi-fluid state and under a relative pressure to substantially completely envelop the outer surfaces of such core, and means thereafter causing such jelly to vibrate within the chamber so as to increase its penetration into the interior portions thereof until said core is substantially completely filled with such jelly.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
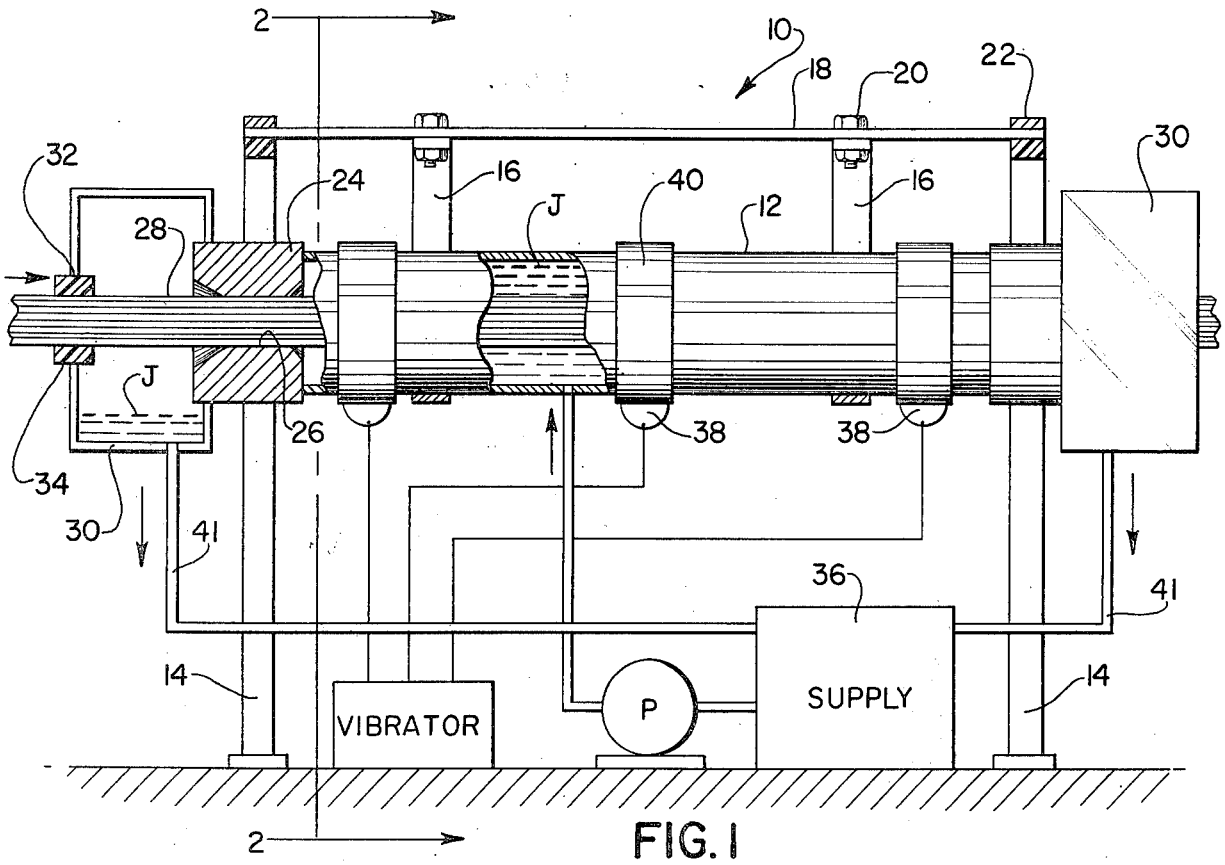
FIG. 1 is a side elevational view partially in section of the jelly tube construction of the present invention.

Turning now to the drawing, and particularly FIG. 1 thereof, the system 10 of the present invention is disclosed as comprising a jelly tube 12 of hollow, generally longitudinally orientated cylindrical construction supported at spaced locations by means of a frame 14 including a pair of hook-shaped supporting element 16 adapted to partially underlie outside wall portions of the jelly tube 12. The supports 16 are in turn supported from a rod 18 by means of bolt assembly 20. The rod 18 is supported at opposite ends by the frame members 14 in such a manner that the vibrational energy imparted either to the jelly within the tube or the tube 12 itself is dampened and includes the rubber mounts 22 depicted.

Each end of the jelly tube 12 is provided with a die element 24 having an internal receiving bore 26 of such dimension so as to engage and support the core 28 entering, passing through and exiting from such tube 12. Adjacent each die structure is an overflow box 30 for receipt of excess jelly J as may ooze from within the confines of the chamber 12 outwardly through either of the dies 24. Each overflow box 30 is in turn provided with an entrance and exit portion to accomodate the passage of the core 28 therethrough; an entrance opening 32 being depicted in FIG. 1, which opening 32 may be sealed as by a rubber or similar seal 34 when it is desired to either pressurize or evacuate the system so as to assist in removing air trapped within the interstitial voids within the interior portions of the core 28. It should be clear that the core 28 as previously indicated in the prior art discussion, may be and generally is made up of a plurality of individually stranded insulated conductors, there being as many as several hundred of such conductors bunched together to form such core, and that the jelly material may be any of the water resistant material previously indicated or otherwise satisfactory.

The system 10 is further provided with a jelly supply 36 and means such as the pump P for supplying such jelly to interior portions of the chamber 12 under pressurized conditions, it being clear that such pressure comprises a portion of the driving force in which the jelly is forced into the interstitial voids of the cable core passing therethrough. In order to more quickly remove air from the interstitial voids within the core 28, it has been found that by imparting vibrational energy to the jelly J, such will more quickly penetrate into the interior portions of the core and at the same time more completely fill said interior portions thus permitting higher production speeds as well as more complete jelly penetration. Also since the jelly impregnation step is generally one of the slower of several other steps needed to produce suitable cable such as telephone communication cable, it is particularly important that such step is speeded up since such may facilitate increased speeds of the entire cable forming line. Lines of this nature also represent large fixed costs and their more productive use as at higher speeds can result in substantial cost savings in the final cable product.

Figure 2:
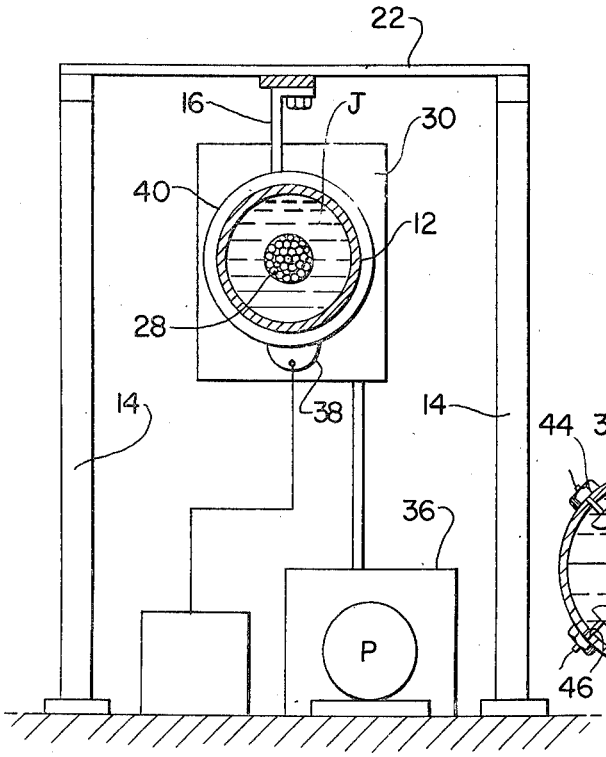
FIG. 2 is an end partial sectional view thereof taken along the line 2—2 of FIG. 1.

In the embodiment shown in FIGS. 1 and 2 of the drawings, the vibrational energy is imparted to the jelly by means of a plurality of transducers 38 attached to bands 40 at least partially encircling outer portions of the jelly tube 12 at axially spaced locations therealong. Such transducers 38 are in turn separately connected to a common source of wave form energy, such as the vibrator indicated. The nature of the vibratory energy may be low frequency, high frequency or ultrasonic, and the particular elements forming the transducers 38 may be electrical coil or piezoelectric crystals, depending on the wave frequency selected. Such transducers 38, however, are capable of generating vibratory waves which are in turn transmitted to the jelly J causing such to vibrate and accordingly assist such in its movement into the interstitial voids deep within the core structure 28, thus forcing out air entrapped therein. Such air, along with any excess jelly, passes out of the entrance and exit die portions 24 to be entrapped by the overflow chambers or boxes 30 and thereafter move by means of tubes 41 back to the supply tank 36 for ultimate recycling back into the chamber 12. In this fashion, both the rapid removal of the air voids and the resulting movement of the jelly completely into the interstices of the core 28 and the efficient recycling of excess jelly material J is accomplished.

As above discussed, any suitable type of transducer may be utilized and may vary in type and vibrational output, dependent in part upon the electrical force applied thereto by means of the vibrator.

Figure 3:
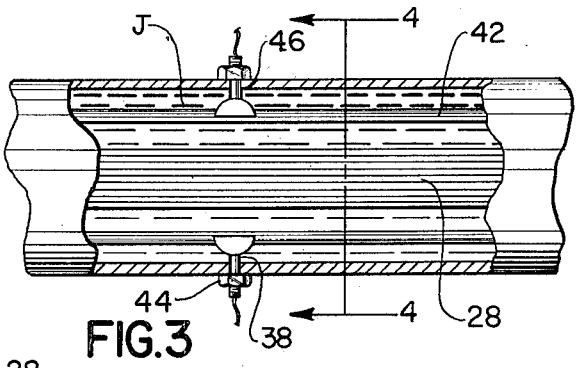
FIG. 3 is a partial sectional view of a portion of a modified jelly tube construction in which vibrational force is applied to a plurality of rods disbursed within the jelly tube.
Figure 4:
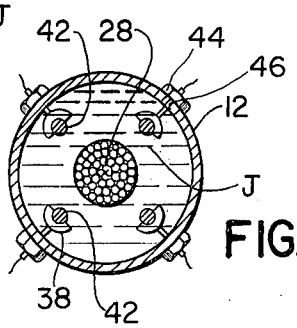
FIG. 4 is an end sectional view taken along the line 4—4 thereof.

Turning now to FIGS. 3 and 4 of the drawing, a modified form of the invention is depicted wherein a plurality of rods 42 are mounted within interior portions of the jelly tube 12 axially thereof and positioned in spaced relationship to the core 28 passing therethrough. In such embodiment the transducer 38 may be directly attached to such rods 42 as by appropriate mounting means 44 passing through openings 46 within the tube 12, and in this manner impart vibratory force to each of the rods 42, which force is in turn transmitted to the jelly J along the entire longitudinal extent of the rods 42 to produce a more equal vibratory force distribution to the jelly J within tube 12. The rods 42 may be affixed at opposite ends thereof to the inner portions of the dies 24 in such manner so as to permit such vibratory movement or may be supported centrally by the mounting means 44.

Figure 5:
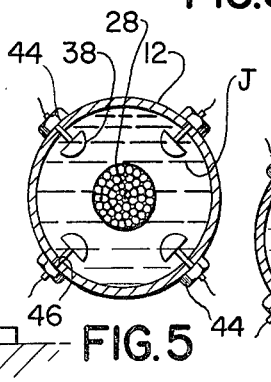
FIG. 5 is an end sectional view similar to FIG. 4 but showing a further modification which the vibratory energy is applied directly to the jelly material itself.

Similarly, in the further modification of the invention depicted in FIG. 5 of the drawings, the transducers 38 may be mounted as in the above-discussed embodiment shown in FIGS. 3 and 4 of the drawing directly through the walls of the tube 12, but into direct contact with the jelly J contained therein, and in this manner directly transmit vibratory motion to the jelly itself without the use of an intermediate vibration transmitting member such as the tube 12 itself or the vibrating rods 42.

In any case, the vibratory action imparted to the jelly J serves to increase the speed in which the jelly moves into the interstitial portions of the core 28 so as to substantially completely fill such with the waterproofing compound in such a manner as to insure a higher quality resultant cable in lower production times and hence at lower production cost. It also should be clear that the vibratory energy may be imparted to the jelly by use of mechanical vibration means as contrasted to the electrically induced vibration systems above discussed; the important feature being the transmittal of such vibratory movement to the jelly in order to accomplish the above-indicated results.

As is conventional in the art, heating means, such as induction wiring (not shown), may be applied around the outer surface of tube 12, and then suitable insulation applied thereover, to maintain the tube heated to the desired degree.

While there is shown and described herein certain specific structure embodying the invention, it will be manifest to those skilled in the art that various modifications and rearrangements of the parts may be made without departing from the spirit and scope of the underlyng inventive concept and that the same is not limited to the particular forms herein shown and described except insofar as indicated by the scope of the appended claims.

What is claimed is:

1. A method of waterproofing a core of a communication cable, wherein the core is defined by a plurality of bundled individual material strands that are located in relatively close adjacent parallel relation, comprising the steps of continuously advancing said core through an enclosed filling chamber, directing a jelly-like waterproofing compound in at least a semi-fluid state under pressure into said chamber and in substantially complete enveloping contact with the outer surfaces of said continuously advancing core, and directly vibrating said compound by vibrating means located within said chamber in contact with said compound while maintaining said strands in the relatively close, adjacent parallel relation, wherein said compound is forced between said strands to fill the interstices therebetween, thereby completely waterproofing said strands.

2. The method set forth in claim 1 including the steps of passing said core through entrance and exit pressure seals at opposite ends of said chamber and continually pumping said compound from a supply thereof into said chamber.

3. The method of claim 2 including continually collecting excess compound passing out of said chamber exit and entrance portions and recirculating said excess compound initially to said supply thereof and thereafter to said chamber.

4. Apparatus for waterproofing a core of a communication cable with a jelly-like waterproofing compound wherein the core is defined by a plurality of bundled individual material strands that are located in relatively close adjacent, parallel relation, comprising a substantially elongated, longitudinally oriented filling chamber having entrance and exit portions for the continuous movements of said cable through said chamber, a supply source for said compound located exteriorly of said chamber, a pump for directing said compound from said supply source into said chamber for complete enveloping contact with said cable passing through said chamber and for maintaining said compound under pressure in said chamber, and means for vibrating said compound in said chamber for causing said compound to penetrate into and fill the interstices between individual material strands of said core for the effective waterproofing thereof, said vibrating means including a plurality of transducers that are located interiorly of said chamber in direct contact with said compound and in spaced, substantially radial disposition with respect to said core.

5. The apparatus set forth in claim 4 wherein compound overflow subchambers are positioned adjacent the entrance and exit portions of said filling chamber and means connected to said subchambers for recirculating compound from said subchambers to said supply means.

6. The apparatus set forth in claim 4, including a plurality of longitudinally orientated rods positioned in said chamber and spaced about said core, each of said transducers being in direct contact with one of said rods to vibrate such rods so as to in turn impart vibration to said compound.

7. The apparatus set forth in claim 6, said rods extending along a major portion of said chamber and supported intermediate said extent by said transducers.

* * * * *